US006872922B2

(12) United States Patent
Uhl

(10) Patent No.: US 6,872,922 B2
(45) Date of Patent: Mar. 29, 2005

(54) METHOD FOR OPERATING A MULTI-STAGE ELECTRICAL HEATER COMPRISED OF SEVERAL HEATING ELEMENTS

(75) Inventor: Günther Uhl, Helmstadt-Bargen (DE)

(73) Assignee: Beru AG, Ludwigsburg (DE)

( * ) Notice: Subject to any disclaimer, the term of this patent is extended or adjusted under 35 U.S.C. 154(b) by 122 days.

(21) Appl. No.: 10/252,817

(22) Filed: Sep. 24, 2002

(65) Prior Publication Data

US 2004/0056018 A1 Mar. 25, 2004

(30) Foreign Application Priority Data

Sep. 25, 2001 (DE) ..... 101 47 074

(51) Int. Cl.[7] ..... H05B 3/02
(52) U.S. Cl. ..... 219/483; 219/484
(58) Field of Search ..... 219/476, 477, 219/480, 482, 483, 484, 485, 490

(56) References Cited

U.S. PATENT DOCUMENTS 4,394,564 A * 7/1983 Dills ..... 219/448.17
6,559,426 B2 * 5/2003 Jirmann ..... 219/480
6,584,889 B2 * 7/2003 Friel, Sr. ..... 99/327

FOREIGN PATENT DOCUMENTS

| | | | |
|---|---|---|---|
| DE | 41 30 337 | A1 | 3/1993 |
| DE | 199 48 313 | A1 | 4/2001 |
| EP | 1 091 621 | A1 | 4/2001 |
| EP | 1 157 869 | A2 | 11/2001 |

* cited by examiner

*Primary Examiner*—S. Paik
(74) *Attorney, Agent, or Firm*—Nixon Peabody LLP; David S. Safran

(57) ABSTRACT

A method for operating a multi-stage electrical heater comprised of several heating elements. In conventional multi-stage electrical heaters, the resistance value of the individual heating elements scatters. In order that the individual heating elements emit the same power, specifically the required nominal power, despite the scattered resistance values, the voltage on the individual heating elements is separately regulated down to the required nominal power, proceeding from a maximum electrical resistance of the individual heating elements, at which the entire applied operating voltage yields the nominal power of the individual heating elements required for operation.

2 Claims, No Drawings

METHOD FOR OPERATING A MULTI-STAGE ELECTRICAL HEATER COMPRISED OF SEVERAL HEATING ELEMENTS

BACKGROUND OF THE INVENTION

1. Field of the Invention

The invention relates to a method for operating a multi-stage electrical heater comprised of several heating elements.

2. Description of Related Art

A multi-stage electrical heater, e.g., a heater with a positive resistance temperature coefficient PTC, is formed of several individual elements, which often are referred to as heating rods, and which are electrically connected in parallel. Each heating element can in turn consist of several sub-elements, i.e., individual PCT blocks.

Each individual heating element can be activated or deactivated via a switch, for example, an electronic switch. The power $P_H$ consumed in a heating element, i.e., the supplied electrical power equal to the emitted thermal power, depends on the electrical resistance $R_H$ of the heating element at the working point at a preset operating voltage $U_B$.

$$PH=(U_B)^2/R_H$$

However, the electrical resistance $R_H$ of the heating elements is subjected to high variations owing to the production process. As a result, the respective power emitted by the heating elements scatters as well. In order to satisfy the requirement of, for example, air-conditioning system manufacturers on a specific power at a set working point, extensive measures, e.g., compensating or sorting, are hence necessary to maintain the electrical resistance $R_H$ of the individual heating elements required for the working point.

A heater composed of several heating elements may satisfy the requirement for a specific overall power, but the heating power of the individual heating elements may vary. Due to the heating power generally emitted over a larger surface, this results in a formation of temperature layers of air streaming out of the heater. The heated air has noticeable temperature differences over the outlet surface. This is undesired, for example, in heating or air-conditioning systems, since it leads to irregularities in how the temperature in a heated space, e.g., the interior of a vehicle, is controlled. As a consequence, all individual heating elements of a heater should consume or emit the same power.

SUMMARY OF THE INVENTION

A primary object of the present invention is to provide a method of the type mentioned at the outset that ensures that all heating elements consume, convert or emit the same power, even if the individual heating elements have varying resistance values.

This object is achieved according to the invention in that, proceeding from a maximum electrical resistance of the individual heating elements, at which the full applied operating voltage yields the nominal power of the individual heating elements required for operation, the voltage on the individual heating elements is separately regulated down to the required nominal power.

In the following, the method according to the invention will be described in detail based on a particularly preferred embodiment.

DETAILED DESCRIPTION OF THE INVENTION

The power consumed and converted in a multi-stage, electrical heater, and hence in each heating element, is maintained at a preset value $P_{Hset}$ by regulating the electrical power consumption. In an n-stage heater, each heating element is therefore kept at a preset value $P_{Hset}/n$. This preset value can be variable, so that the power emitted by the heater can be set.

Each individual heating element is individually regulated, thereby substantially simplifying the dimensioning of the individual heating elements. All that need be ensured is that the variation or scatter of electrical resistance $R_H$ of the individual heating elements does not exceed a value $R_{Hmax}$. At this assumed maximum value for resistance, a heating element just reaches its nominal power required at the working point if the full operating voltage $U_B$ is applied:

$$P_K=(U_B)^2/R_{Hmax}$$

If the resistance $R_H$ of an individual heating element lies under the value $R_{Hmax}$, the voltage on the heating element, and hence the power consumption of the heating element, is reduced to the required value $P_K$, e.g., by cycling the operating voltage, in particular via pulse-width modulation. The power consumption of the heating element is determined by measuring the applied voltage and absorbed current.

Another advantage to regulating the individual heating elements to the required nominal power in this way is that not just the variation of the resistance $R_H$ of the heating elements can be compensated, but fluctuations in operating voltage $U_B$ can also be adjusted, as long as this voltage $U_B$ does not drop to below a minimum value $U_{Bmin}$. The following applies here:

$$U_{Bmin}=(P_H{*}R_H)^{1/2}.$$

The advantage to the method according to the invention is that, despite the variations or scatters in the resistance of the heating elements, the nominal power required at the working point can be maintained, the escaping stream of air has the same temperature everywhere, i.e., no temperature layer formation takes place, and the sorting outlay for the heating elements relative to their electrical resistance is substantially reduced, which greatly diminishes or even eliminates rejects. Depending on the variation range, sorting can even be omitted entirely. Sorted individual heating elements can be used in heaters with other nominal powers.

What is claimed is:

1. A method for operating a multi-stage electrical heater comprised of several heating elements, each of which has an operating voltage that is individually regulatable in a range up to a full operating voltage, comprising the steps of:

initially applying the full operating voltage to the individual heating elements required for operation at the maximum electrical resistance of the individual heating elements, and then, separately regulating the voltage to each of the individual heating elements for which a required domain power for the heater is exceeded, down to the required nominal power for the heater based on the actual resistance thereof.

2. The method according to claim 1, wherein an upper value of the range in which the heating elements are individually regulatable is the maximum electrical resistance of the individual heating elements.

* * * * *